US009416469B2

(12) United States Patent
Woodruff et al.

(10) Patent No.: US 9,416,469 B2
(45) Date of Patent: Aug. 16, 2016

(54) FLEXIBLE, ABRASION RESISTANT WOVEN TEXTILE SLEEVE AND METHOD OF CONSTRUCTION THEREOF

(71) Applicant: Federal-Mogul Powertrain, Inc., Southfield, MI (US)

(72) Inventors: Alexa A. Woodruff, Bryn Mawr, PA (US); Cassie M. Malloy, Trappe, PA (US)

(73) Assignee: Federal-Mogul Powertrain, Inc., Southfield, MI (US)

( * ) Notice: Subject to any disclaimer, the term of this patent is extended or adjusted under 35 U.S.C. 154(b) by 0 days.

(21) Appl. No.: 14/636,662

(22) Filed: Mar. 3, 2015

(65) Prior Publication Data

US 2015/0337465 A1 Nov. 26, 2015

Related U.S. Application Data

(60) Provisional application No. 62/001,439, filed on May 21, 2014.

(51) Int. Cl.

| | |
|---|---|
| ***D03D 3/02*** | (2006.01) |
| ***D03D 15/00*** | (2006.01) |
| ***D03D 13/00*** | (2006.01) |

(52) U.S. Cl.

CPC ..... *D03D 3/02* (2013.01); *D03D 13/004* (2013.01); *D03D 15/00* (2013.01); *D10B 2401/04* (2013.01)

(58) Field of Classification Search

CPC ..... D03D 3/02; D03D 13/008; D03D 1/0035; D03D 15/00; D03D 1/0041; D03D 13/004; D03D 13/00; H02G 3/0481; H02G 3/0487; D06C 7/02

See application file for complete search history.

(56) References Cited

U.S. PATENT DOCUMENTS

| | | | | |
|---|---|---|---|---|
| 4,174,739 | A * | 11/1979 | Rasero | D03D 3/02 139/383 A |
| 4,368,760 | A | 1/1983 | Frommert | |
| 4,836,080 | A | 6/1989 | Kite, III et al. | |
| 5,413,149 | A | 5/1995 | Ford et al. | |
| 5,467,802 | A | 11/1995 | Lusen et al. | |
| 5,555,918 | A | 9/1996 | Lusen et al. | |

(Continued)

FOREIGN PATENT DOCUMENTS

WO 2007103779 A1 9/2007

OTHER PUBLICATIONS

International Search Report, mailed Jun. 1, 2015 (PCT/US2015/018448).

*Primary Examiner* — Bobby Muromoto, Jr.

(74) *Attorney, Agent, or Firm* — Robert L. Stearns; Dickinson Wright, PLLC

(57) ABSTRACT

A woven sleeve and method of construction are provided. The sleeve has a flexible, abrasion resistant, self-curling elongate wall constructed from woven monofilament and/or multifilament yarns. The wall has opposite edges extending generally parallel to a central axis of the sleeve, wherein the opposite edges overlap one another. The wall is woven with warp yarns that extend generally parallel to the central axis of the sleeve and fill yarns that extend circumferentially about the sleeve, generally transversely to the central axis. The warp yarns are bundled into individual, discrete groups, with each group including a plurality of yarns in side-by-side relation with one another, wherein each of the yarns within the same discrete group is interlaced over the same side of a common fill yarn.

20 Claims, 5 Drawing Sheets

(56) References Cited

U.S. PATENT DOCUMENTS

| | | | | |
|---|---|---|---|---|
| 5,556,495 | A | 9/1996 | Ford et al. | |
| 5,843,542 | A * | 12/1998 | Brushafer | F16L 11/02 138/123 |
| 6,227,094 | B1 * | 5/2001 | Taylor | D04C 1/06 87/8 |
| 6,718,100 | B2 | 4/2004 | Morris | |
| 7,085,458 | B2 | 8/2006 | Morris | |
| 7,216,678 | B2 * | 5/2007 | Baer | D03D 3/08 139/383 R |
| 7,874,184 | B2 | 1/2011 | Malloy et al. | |
| 8,263,504 | B2 | 9/2012 | Bouillon et al. | |
| 8,426,326 | B2 | 4/2013 | Bouillon et al. | |
| 8,444,827 | B2 | 5/2013 | Quigley | |
| 9,091,002 | B2 * | 7/2015 | Malloy | D03D 3/02 |
| 2006/0016507 | A1 * | 1/2006 | Baer | D03D 3/08 139/383 R |
| 2007/0210490 | A1 * | 9/2007 | Malloy | D03D 15/02 264/425 |
| 2008/0135119 | A1 | 6/2008 | Tonooka et al. | |
| 2012/0132309 | A1 * | 5/2012 | Morris | D03D 3/005 138/115 |
| 2013/0040081 | A1 | 2/2013 | Yoshimura et al. | |
| 2013/0130008 | A1 | 5/2013 | Deguchi et al. | |
| 2013/0206275 | A1 * | 8/2013 | Itoh | B60R 16/02 139/35 |
| 2013/0228248 | A1 * | 9/2013 | Malloy | D03D 3/02 139/35 |
| 2016/0016376 | A1 * | 1/2016 | Woodruff | B32B 5/26 428/190 |

* cited by examiner

FLEXIBLE, ABRASION RESISTANT WOVEN TEXTILE SLEEVE AND METHOD OF CONSTRUCTION THEREOF

CROSS-REFERENCE TO RELATED APPLICATION

This application claims the benefit of U.S. Provisional Application Ser. No. 62/001,439, filed May 21, 2014, which is incorporated herein by reference in its entirety.

BACKGROUND OF THE INVENTION

1. Technical Field

This invention relates generally to textile sleeves for protecting elongate members, and more particularly to woven sleeves.

2. Related Art

It is known to wrap wires and wire harnesses in protective sleeves, such as in automobiles, aircraft or aerospace craft, to provide protection to the wires against abrasion, fluid and thermal affects. In order to achieve the desired protection, the protective sleeve may have multiple layers, with some of the layers being specifically provided for different types of protection. For example, one layer may be provided for water resistance, e.g. a sheet of plastic material, while another layer may be provided for abrasion resistance, and yet another layer may be provided for protection against thermal conditions, e.g. a non-woven layer. Although the aforementioned multilayer sleeves may provide suitable protection against the various environmental conditions, unfortunately they are typically bulky, thereby requiring an increased volume of space, and further, they tend to be relatively heavy and exhibit low flexibility. This can prove detrimental in some applications, particularly applications requiring routing cables or hoses through tight, winding areas, as well as applications having weight restrictions, such as aircraft and aerospace applications, for example.

SUMMARY OF THE INVENTION

One aspect of the invention provides a woven sleeve for routing and protecting elongate members from exposure to abrasion and other environmental conditions, such as contamination. The sleeve has a flexible, abrasion resistant, self-curling elongate wall constructed from woven monofilament and/or multifilament yarns. The wall has opposite edges extending generally parallel to a central axis of the sleeve, wherein the opposite edges overlap one another. The wall is woven with warp yarns that extend generally parallel to the central axis of the sleeve and fill yarns that extend circumferentially about the sleeve, generally transversely to the central axis. The warp yarns are bundled into individual, discrete groups, with each group including a plurality of yarns in side-by-side relation with one another, wherein each of the yarns within the same discrete group is interlaced over the same side of a common fill yarn. The groups of bundled warp yarns provide enhanced abrasion resistance to abrasion forced applied along the length of the sleeve, while the fill yarns provide the sleeve with enhanced flexibility.

In accordance with another aspect of the invention, the discrete bundles can extend over a single fill yarn and under a single fill yarn in repetition.

In accordance with another aspect of the invention, the discrete bundles can extend over a plurality of the fill yarns and under a plurality of the fill yarns in repetition.

In accordance with another aspect of the invention, each discrete bundle can extend over a pair of the fill yarns and under a pair of the fill yarns in repetition.

In accordance with another aspect of the invention, the opposite edges of the wall can be biased into overlapping relation with one another by the fill yarns.

In accordance with another aspect of the invention, at least some of the warp yarns are provided as multifilament yarns.

In accordance with another aspect of the invention, each of the warp yarns can be provided as a multifilament yarn.

In accordance with another aspect of the invention, each of the fill yarns can be provided as a monofilament yarn.

In accordance with another aspect of the invention, at least some of the warp yarns can be provided as monofilament yarns.

In accordance with another aspect of the invention, each of the warp yarns can be provided as a monofilament yarn.

In accordance with another aspect of the invention, a method of constructing a textile sleeve is provided. The method includes weaving an elongate wall having opposite edges extending parallel to a central longitudinal axis of the sleeve with the wall being having warp yarns extending parallel to the central longitudinal axis and fill yarns extending transverse to the warp yarns. Further, the method includes weaving the warp yarns in discrete bundles of yarns, with each of the bundles having warp yarns arranged in side-by-side abutting relation with one another, wherein the warp yarns in each discrete bundle extends over and under the same fill yarns with one another.

In accordance with another aspect of the invention, the method can further include weaving the bundles over and under a single fill yarn.

In accordance with another aspect of the invention, the method can further include weaving the bundles over a plurality of fill yarns to form outwardly facing floats.

In accordance with another aspect of the invention, the method can further include heat-setting at least some of the fill yarns to bias the opposite edges into overlapping relation with one another.

In accordance with another aspect of the invention, the method can further include providing at least some of the warp yarns as multifilament yarns.

In accordance with another aspect of the invention, the method can further include providing the fill yarns as multifilament yarns.

In accordance with another aspect of the invention, the method can further include providing the fill yarns as monofilament yarns.

In accordance with another aspect of the invention, the method can further include providing at least some of the warp yarns as monofilament yarns.

In accordance with another aspect of the invention, the method can further include forming each of the discrete bundles including multifilament and monofilament yarns.

In accordance with another aspect of the invention, the method can further include weaving the warp yarns and the fill yarns in a basket weave pattern.

BRIEF DESCRIPTION OF THE DRAWINGS

These and other aspects, features and advantages will become readily apparent to those skilled in the art in view of the following detailed description of presently preferred embodiments and best mode, appended claims, and accompanying drawings, in which:

DETAILED DESCRIPTION OF PREFERRED EMBODIMENTS

Figure 1:
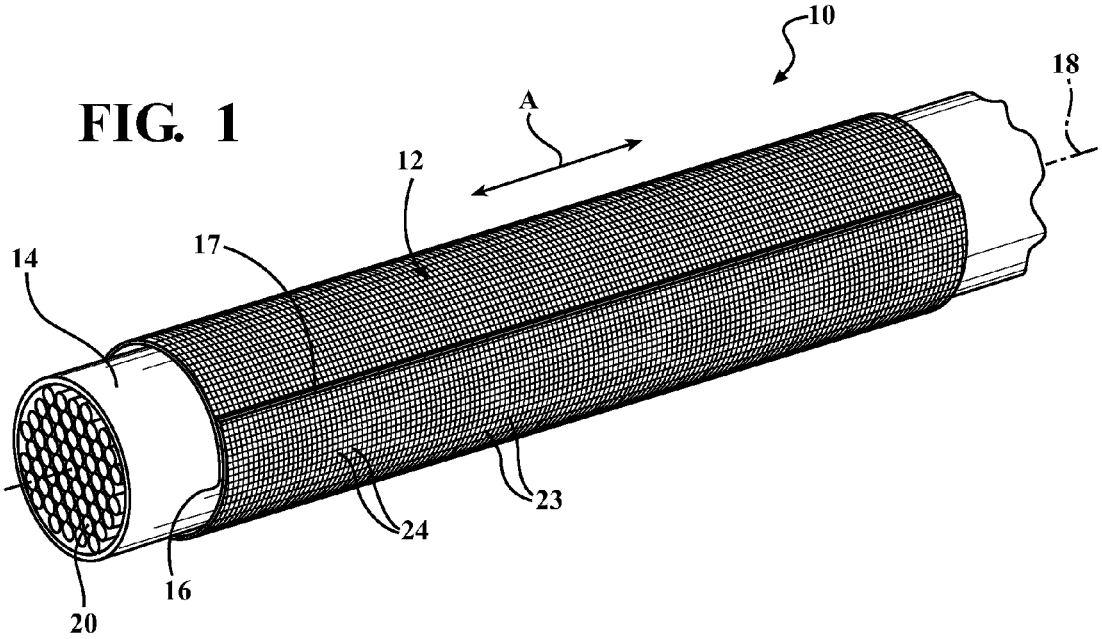
FIG. 1 is schematic perspective view of a woven, self-wrapping sleeve constructed in accordance with one aspect of the invention, with the sleeve shown carrying and protecting elongate members therein.

Referring in more detail to the drawings, FIG. 1 shows schematic representation of a woven, self-wrapping textile sleeve, referred to hereafter as sleeve 10, constructed in accordance with one aspect of the invention. The sleeve 10 has a wrappable elongate wall 12 for routing and protecting elongate members, such as wires or a wire harness 14, for example, from exposure to abrasion and the ingress of contamination, debris and the like. The elongate wall 12 has opposite edges 16, 17 extending generally parallel to a central, longitudinal axis 18, wherein the edges 16, 17 are preferably biased into overlapping relation with one another in "cigarette wrapped" fashion to fully enclose the elongate members 14 within a central cavity 20 of the sleeve 10. The cavity 20 is readily accessible along the full length of the wall 12 so that the elongate members 14 can be readily disposed radially into the cavity 20, and conversely, removed from the cavity 20, such as during service. To provide the desired protection to the elongate members 14 against abrasion, the wall 12 is woven with individual, discrete warp yarn bundles 22 extending generally parallel to the central longitudinal axis 18, wherein each bundle 22 is made up of a plurality of warp yarns 23 arranged in side-by-side, abutting relation with one another. The wall 12 is further woven with weft yarns, also commonly referred to as fill yarns 24, extending generally circumferentially about the wrapped wall 12 in generally transverse relation to the warp yarns 23. The fill yarns 24 can be provided, at least in part, as heat-settable yarns, if desired, such that upon heat-setting the fill yarns 24 while a curled or wrapped configuration, the wall 12 is biased to self-curl the opposite edges 16, 17 into overlapping relation with one another. The bias is imparted by heat-setting the fill yarns 24, such as heat-settable monofilament or multifilament yarns, into their curled configuration about the central longitudinal axis 18.

Depending on the application needs, the wall 12 can be constructed having any suitable size, including length and diameter. When the wall 12 is in its self-wrapped tubular configuration, generally free from any externally applied forces, the edges 16, 17 preferably overlap one another at least slightly to fully enclose the cavity 20, and thus, provide enhanced protection to the wires 14 contained in the cavity 20. The edges 16, 17 are readily extendable away from one another under an externally applied force sufficient to overcome the bias imparted by the fill yarns 24 to at least partially open and expose the cavity 20. Accordingly, the wires 14 can be readily disposed into the cavity 20 during assembly or removed from the cavity 20 during service. Upon releasing the externally applied force, the edges 16, 17 return automatically to their natural, overlapping self-wrapped position under the bias imparted by the heat-set fill monofilament yarns 24.

Figure 2:
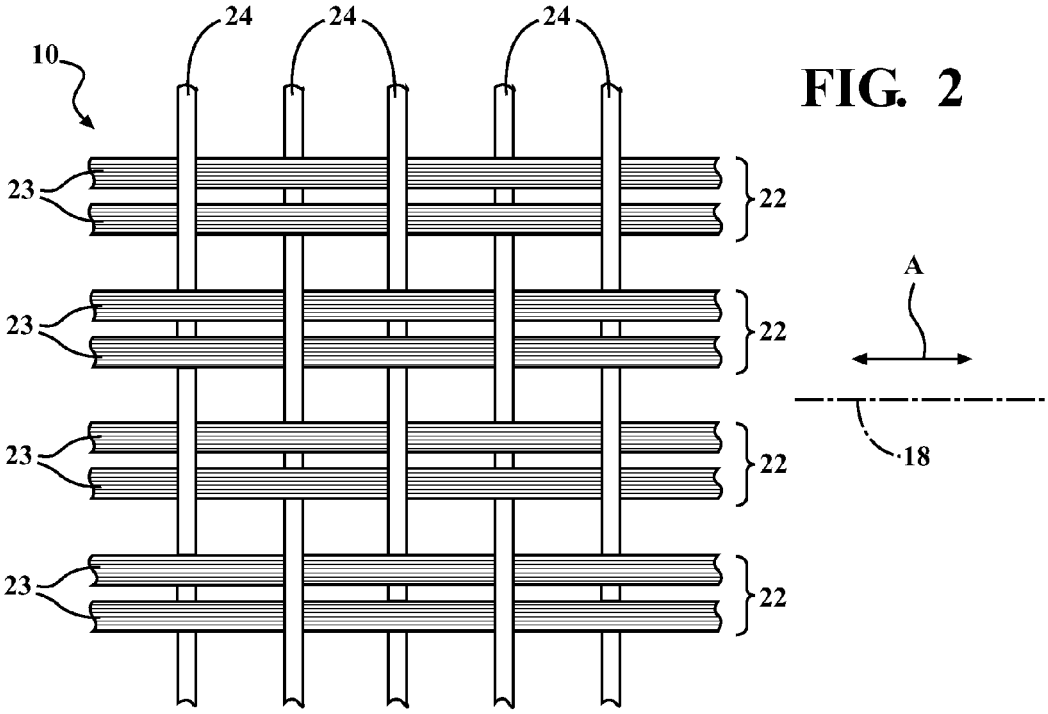
FIG. 2 is an enlarged partial view of a wall of the sleeve of FIG. 1 constructed in accordance with one embodiment of the invention.

The discrete warp yarn bundles 22 can be formed of any suitable monofilament and/or multifilament yarns, with an exemplary embodiment of the bundles 22 being shown in FIG. 2 as being formed entirely with a plurality of multifilament warp yarns 23. The multifilament warp yarns 23, in addition to providing enhanced abrasion resistance as a result of being bundled in side-by-side, abutting or substantially abutting relation with one another, provide enhanced, optimal surface area coverage to the wall 12, thereby inhibiting the ingress of contamination, debris, or the like into the cavity 20, thereby providing enhanced protection to the elongate members 14 contained within the cavity 20. In addition, the multifilament yarns 23 facilitate maintaining the fill yarns 24 in their intended, as woven positions by imparting enhanced friction on the fill yarns 24, while also providing the sleeve 10 with sufficient flexibility for routing around corners, for example. In one exemplary sleeve embodiment, the bundles 22 were formed with pairs of the warp yarns 23, wherein the warp yarns 23 were provided as multifilaments having a denier between about 300-500, with an ends-per-inch between about 75-90. The discrete bundles 22 are shown in FIG. 2, by way of example and without limitation, as being woven in a modified basket-type weave pattern, with each bundle 22 extending over a single fill yarn 24 and then under a single fill yarn 24, in repeating fashion.

The fill yarns 24 can be provided as any suitable monofilament and/or multifilament material, including heat-settable monofilament and/or multifilament polymeric material, such as polyphenylene sulfide (PPS) or polyethyleneterephthalate (PET), for example. In the exemplary sleeve embodiment shown in FIG. 2, the fill yarns 24 are heat-settable monofilaments. The monofilaments 24 preferably have a reduced cross-section area (reduced diameter) relative to the warp yarns 23, which facilitates providing the sleeve 10 with an increased degree of flexibility in comparison to that if the monofilaments were larger.

Figure 2A:
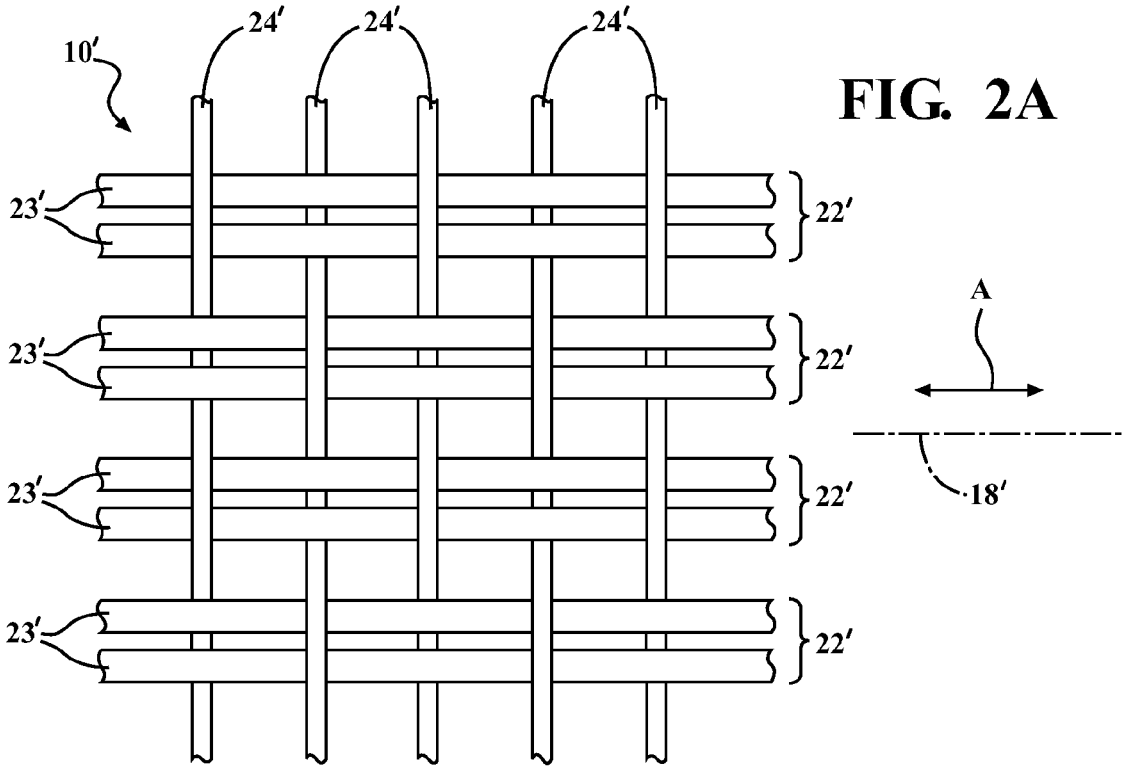
FIG. 2A is a view similar to FIG. 2 of a wall of the sleeve of FIG. 1 constructed in accordance with another embodiment of the invention.

In FIG. 2A, another exemplary embodiment of a sleeve 10' constructed in accordance with the invention is shown, wherein the same reference numerals as used in FIG. 2, coupled with a single prime (’), are used to identify similar features. The sleeve 10' is similar to the sleeve 10 of FIG. 2; however, rather than the warp yarns being provided as multifilaments, the warp yarns 23' are provided as monofilaments, thereby rendering the entire sleeve 10' as being constructed of monofilaments. The monofilaments used for the warp yarns 23' are at least slightly greater in diameter than the monofilaments used for the fill yarns 24'. Otherwise, the pattern of weave of the sleeve 10' is the same as that for the sleeve 10, and thus, no further description is necessary.

Figure 2B:
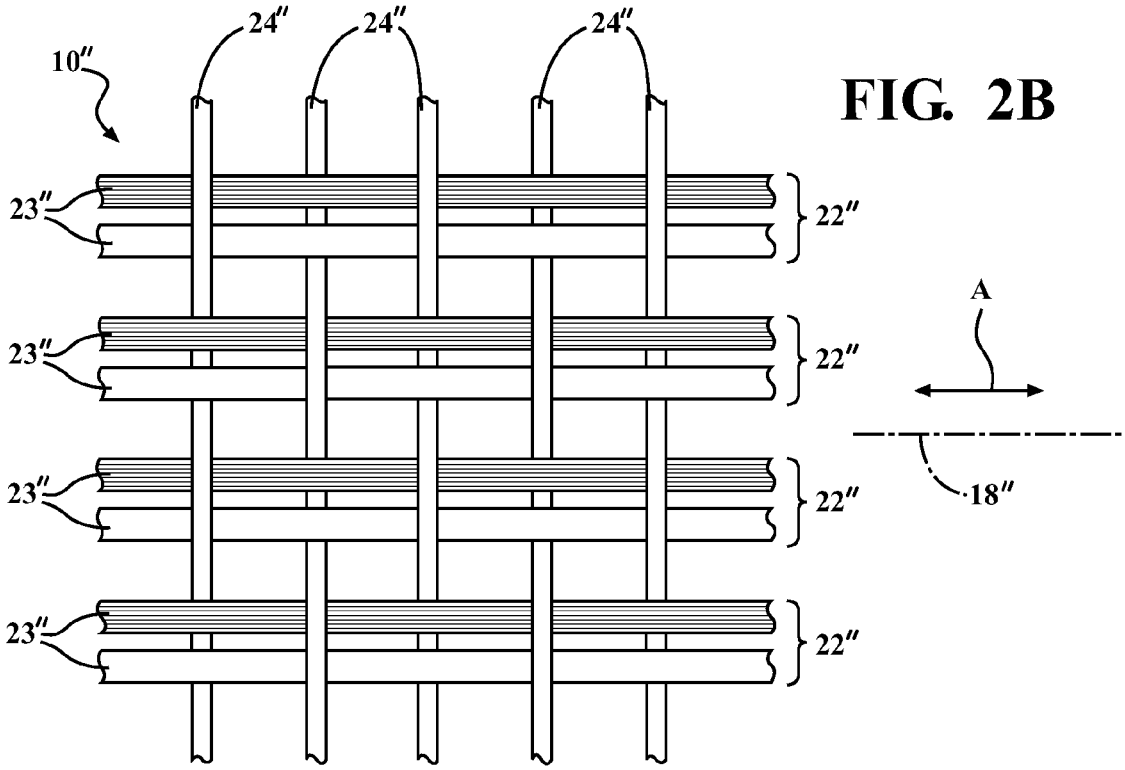
FIG. 2B is a view similar to FIG. 2 of a wall of the sleeve of FIG. 1 constructed in accordance with yet another embodiment of the invention.

In FIG. 2B, another exemplary embodiment of a sleeve 10" constructed in accordance with the invention is shown, wherein the same reference numerals, coupled with a double prime ("), are used to identify similar features. The sleeve 10" is similar to the sleeve 10 of FIG. 2; however, rather than the warp yarns being provided as multifilaments, each discrete bundle 22" is formed with a monofilament warp yarn 23" and a multifilament warp yarn 23". The monofilaments used for the warp yarns 23" can be the same as those used for the warp yarns of the sleeve 10' of the FIG. 2A, while the multifilament warp yarns 23" can be the same as those used for the warp yarns of the sleeve 10, with the effective diameters of the monofilament and multifilament warp yarns 23" being the same or generally the same. Otherwise, the pattern of weave of the sleeve 10" is the same as that for the sleeve 10, and thus, no further description is necessary.

Figure 2C:
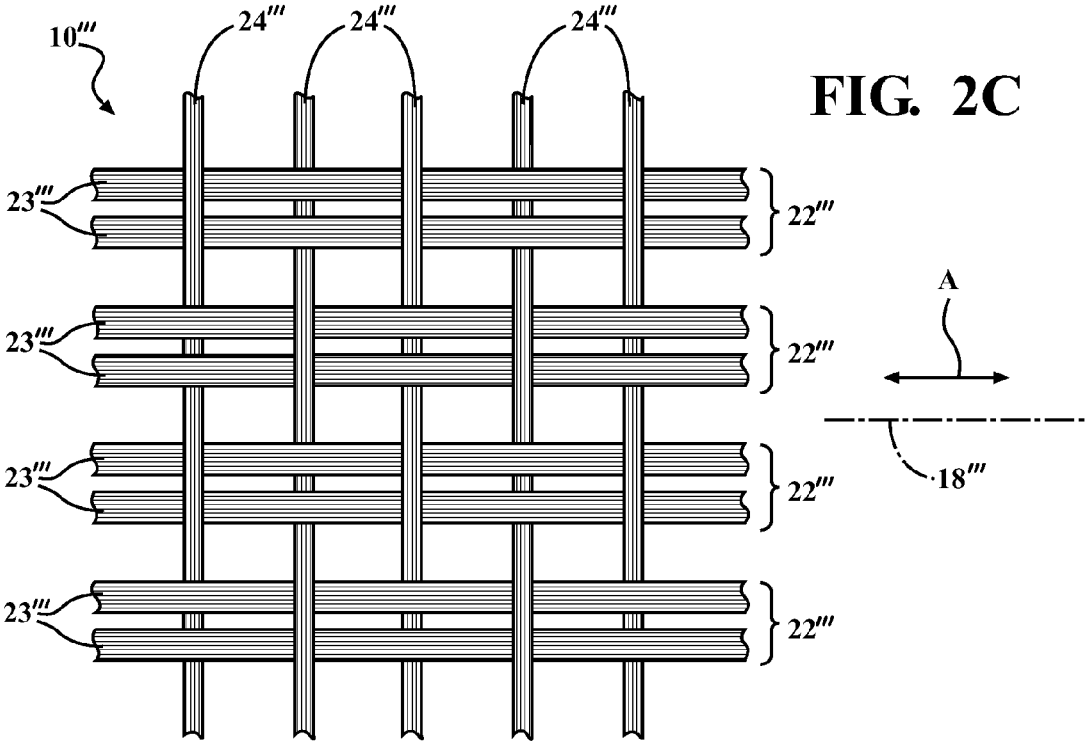
FIG. 2C is a view similar to FIG. 2 of a wall of the sleeve of FIG. 1 constructed in accordance with yet another embodiment of the invention.

In FIG. 2C, another exemplary embodiment of a sleeve 10'" constructed in accordance with the invention is shown, wherein the same reference numerals, coupled with a triple prime ("'), are used to identify similar features. The sleeve 10'" is similar to the sleeve 10 of FIG. 2; however, rather than the fill yarns being provided as monofilaments, the fill yarns 24'" are provided as multifilaments, thereby rendering the entire sleeve 10'" as being constructed of multifilaments. As with all the prior embodiments, the fill yarns 24'" are woven as individual yarn filaments, and thus, do not extend over and under the same warp yarns as an immediately adjacent fill yarn. The fill yarns 24'", as with the previous embodiments, have an effective diameter that is less than the effective diameter of the individual warp yarns 23'", with an exemplary embodiment being constructed with fill yarns 24'" having a denier between about 200-400 with a pick-per-inch between about 30-50. Otherwise, the pattern of weave of the sleeve 10'" is the same as that for the sleeve 10, and thus, no further description is necessary.

Figure 3:
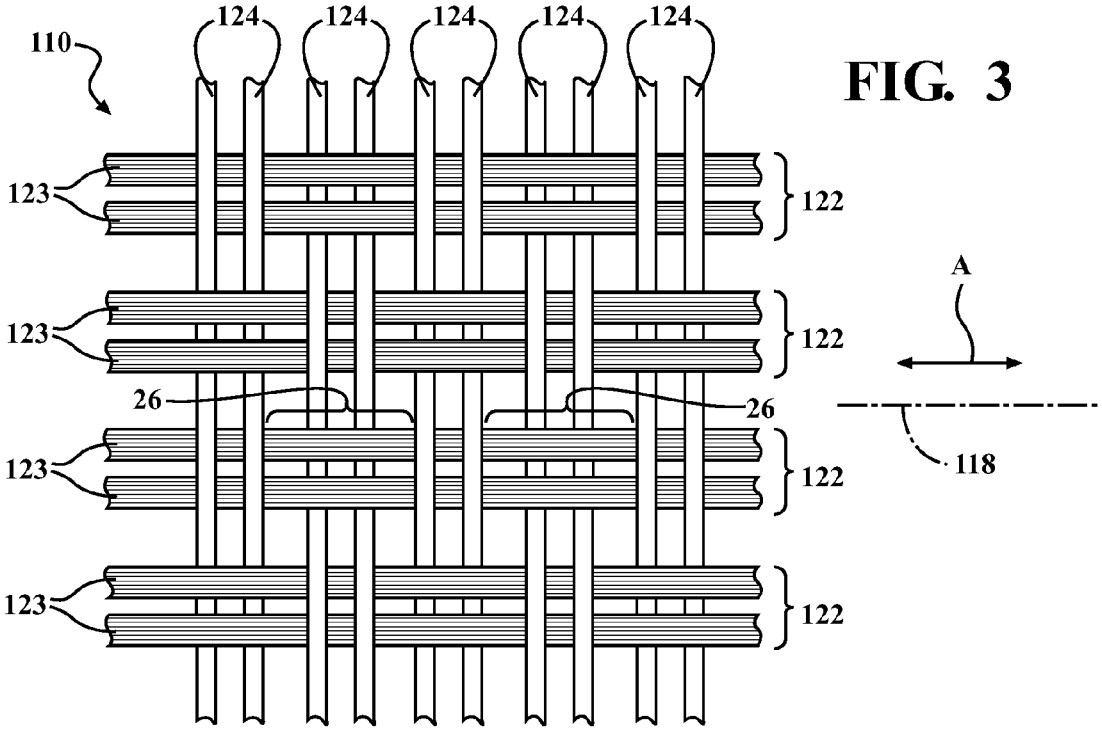
FIG. 3 is a view similar to FIG. 2 of a wall of the sleeve of FIG. 1 constructed in accordance with yet another embodiment of the invention.

In FIG. 3, another exemplary embodiment of a sleeve 110 constructed in accordance with the invention is shown, wherein the same reference numerals as used in FIG. 2, offset by a factor of 100, are used to identify like features. The sleeve 110 is similar to the sleeve 10 of FIG. 2; however, rather than the warp yarns 123 and bundles 122 thereof extending over and under a single monofilament fill yarn 123, the discrete bundles of warp yarns 123 extend over a pair of fill yarns 124 and then under a pair of fill yarns 124 in a repetitious pattern, thereby forming a true basket weave pattern. As such, the warp yarns 123 form outwardly facing warp floats 26 extending over a plurality of the fill yarns 124, wherein the floats 26 function to provide further enhanced protection against abrasive forces sliding along the length of the sleeve 10 in the direction indicated by arrow A. Otherwise, the sleeve 110 remains the same as discussed for the sleeve 10 of FIG. 2, such that the yarn materials and relative sizes for the warp yarns 123 and the fill yarns 124 are the same, and thus, no further discussion is needed.

Figure 3A:
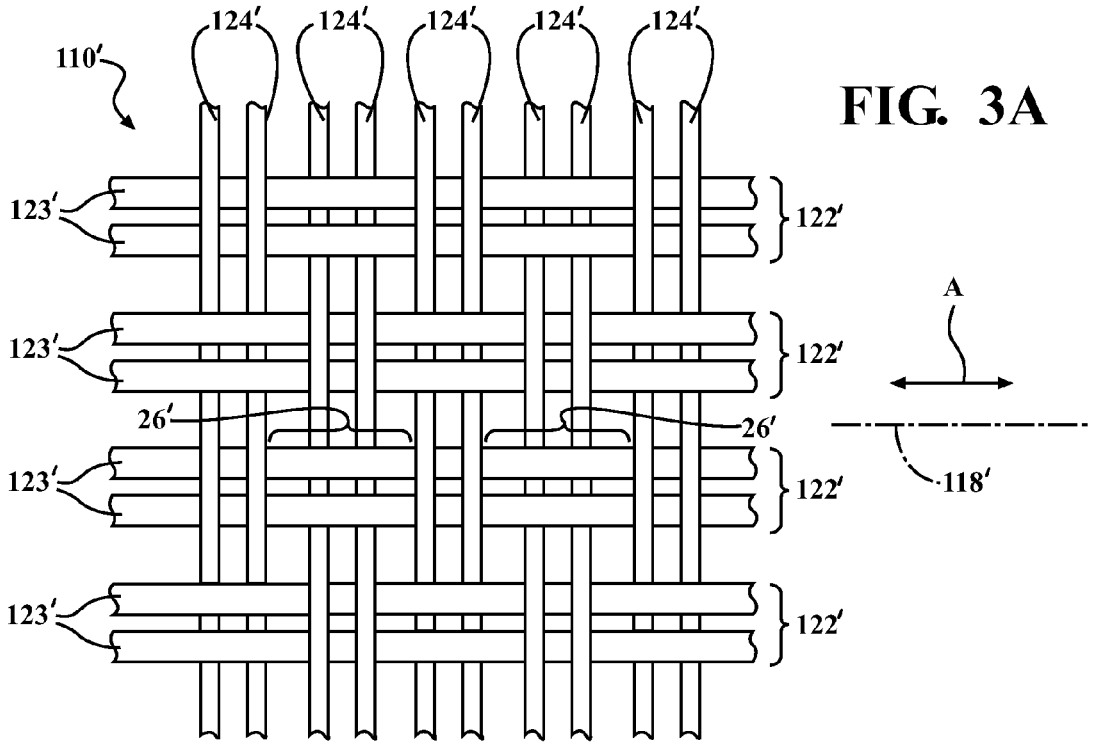
FIG. 3A is a view similar to FIG. 3 of a wall of the sleeve of FIG. 1 constructed in accordance with yet another embodiment of the invention.

In FIG. 3A, another exemplary embodiment of a sleeve 110' constructed in accordance with the invention is shown, wherein the same reference numerals as used in FIG. 3, coupled with a single prime ('), are used to identify similar features. The sleeve 110' is similar to the sleeve 110 of FIG. 3; however, rather than the warp yarns being provided as multifilaments, the warp yarns 123' are provided as monofilaments, thereby rendering the entire sleeve 110' as being constructed of monofilaments. The monofilaments used for the warp yarns 123' are at least slightly greater in diameter than the monofilaments used for the fill yarns 124'. Otherwise, the pattern of weave of the sleeve 110' is the same as that for the sleeve 110, and thus, no further description is necessary.

Figure 3B:
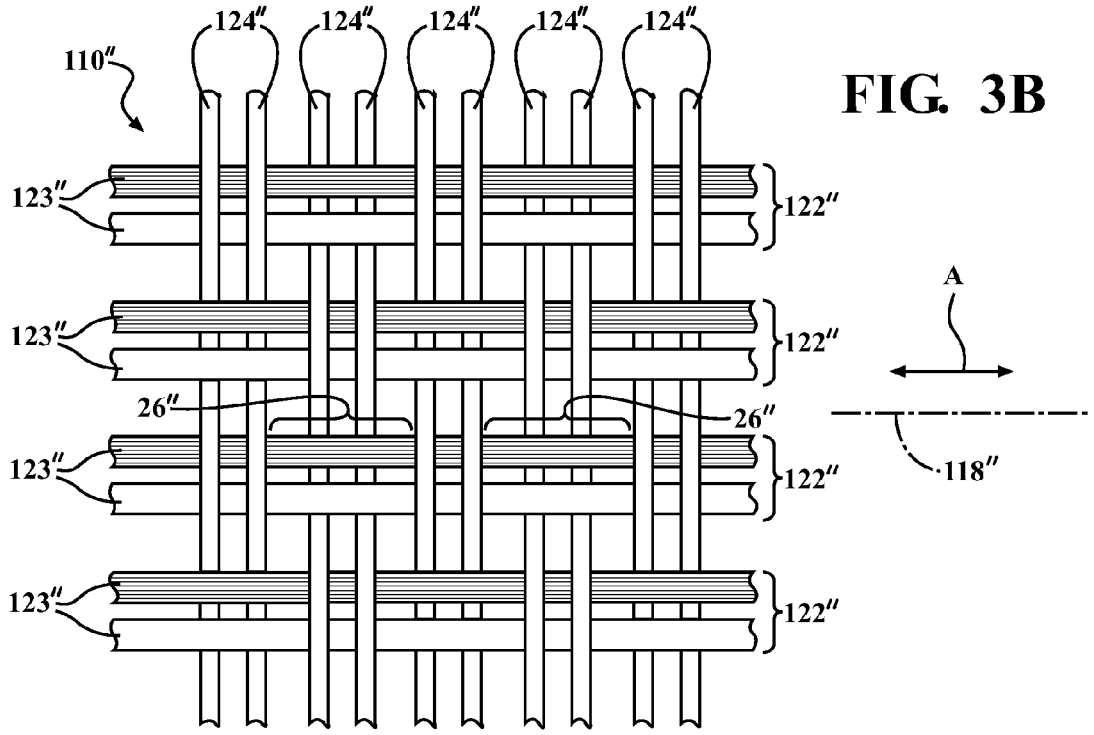
FIG. 3B is a view similar to FIG. 3 of a wall of the sleeve of FIG. 1 constructed in accordance with yet another embodiment of the invention.

In FIG. 3B, another exemplary embodiment of a sleeve 110" constructed in accordance with the invention is shown, wherein the same reference numerals as used in FIG. 3, coupled with a double prime ("), are used to identify similar features. The sleeve 110" is similar to the sleeve 110 of FIG. 3; however, rather than the warp yarns being provided as multifilaments, each discrete bundle 122" is formed with a monofilament warp yarn 123" and a multifilament warp yarn 123", thereby resulting in a monofilament and a multifilament being in side-by-side, abutting relation with one another. The monofilaments used for the warp yarns 123" can be the same as those used for the warp yarns of the sleeve 110' of the FIG. 3A, while the multifilament warp yarns 123" can be the same as those used for the warp yarns of the sleeve 110 of FIG. 3, with the effective diameters of the monofilament and multifilament warp yarns 123" being the same or generally the same. Otherwise, the pattern of weave of the sleeve 110" is the same as that for the sleeve 110, and thus, no further description is necessary.

Figure 3C:
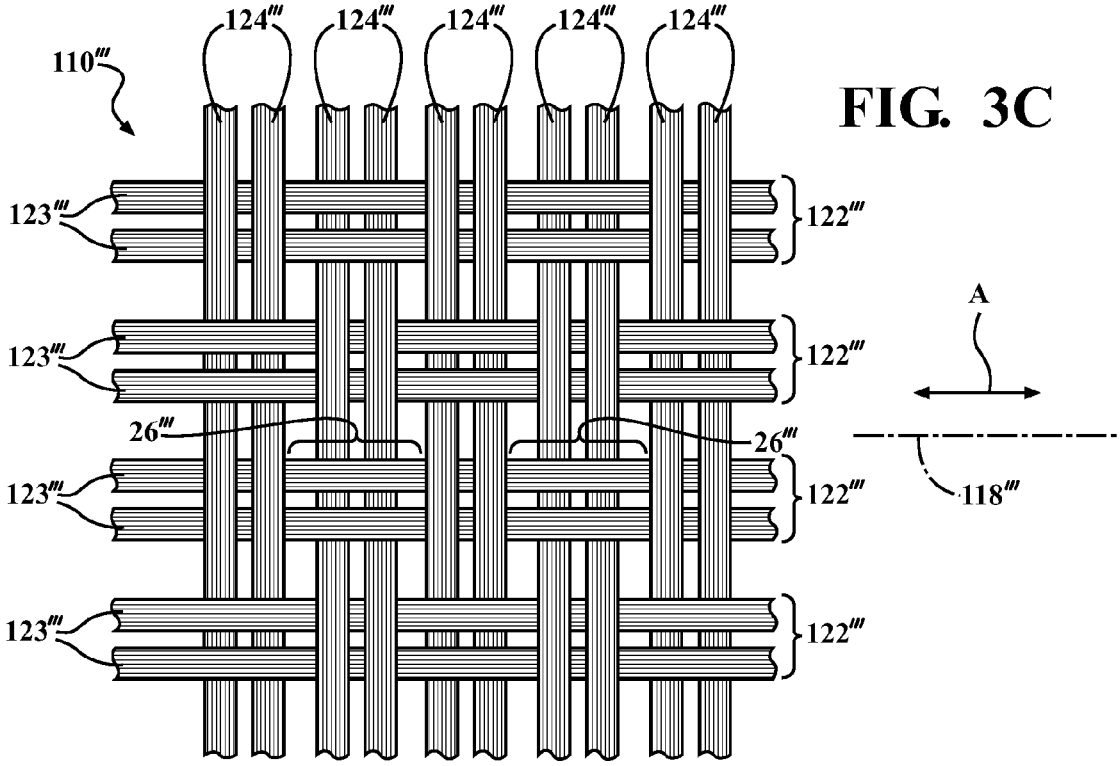
FIG. 3C is a view similar to FIG. 3 of a wall of the sleeve of FIG. 1 constructed in accordance with yet another embodiment of the invention.

In FIG. 3C, another exemplary embodiment of a sleeve 110'" constructed in accordance with the invention is shown, wherein the same reference numerals as used in FIG. 3, coupled with a triple prime ("'), are used to identify similar features. The sleeve 110'" is similar to the sleeve 110 of FIG. 3; however, rather than the fill yarns being provided as monofilaments, the fill yarns 124'" are provided as multifilaments, thereby rendering the entire sleeve 110'" as being constructed of multifilaments. The fill yarns 124'", as with the previous embodiments, have an effective diameter that is less than the effective diameter of the individual warp yarns 123'", with an exemplary embodiment being constructed with fill yarns 124'" having a denier between about 200-400 with a pick-per-inch between about 30-50. Otherwise, the pattern of weave of the sleeve 110'" is the same as that for the sleeve 110, and thus, no further description is necessary.

Obviously, many modifications and variations of the present invention are possible in light of the above teachings. It is, therefore, to be understood that within the scope of the appended claims, the invention may be practiced otherwise than as specifically described.

What is claimed is:

1. A woven textile sleeve for routing and protecting elongate members, comprising:

an elongate wall having opposite edges extending parallel to a longitudinal central axis of the sleeve, said wall being woven with warp yarns extending parallel to said central longitudinal axis and fill yarns extending transversely to said warp yarns, said warp yarns being woven as discrete bundles of warp yarns, wherein each said discrete bundle includes a plurality of warp yarns arranged in side-by-side abutting relation with one another, with said warp yarns in each discrete bundle extending over and under the same said fill yarns with one another.

2. The textile sleeve of claim 1 wherein each said discrete bundle extends over a single fill yarn and under a single fill yarn in repetition.

3. The textile sleeve of claim 1 wherein each said bundle extends over a plurality of said fill yarns and under a plurality of said fill yarns in repetition.

4. The textile sleeve of claim 3 wherein each said bundle extends over a pair of said fill yarns and under a pair of said fill yarns in repetition.

5. The textile sleeve of claim 1 wherein said opposite edges are biased into overlapping relation with one another by said fill yarns.

6. The textile sleeve of claim 1 wherein at least some of said warp yarns are provided as multifilament yarns.

7. The textile sleeve of claim 6 wherein each of said warp yarns is provided as a multifilament yarn.

8. The textile sleeve of claim 7 wherein each of said fill yarns is provided as a monofilament yarn.

9. The textile sleeve of claim 6 wherein at least some of said warp yarns are provided as monofilament yarns.

10. The textile sleeve of claim 1 wherein each said warp yarns is provided as a monofilament yarn.

11. A method of constructing a textile sleeve, comprising:

weaving an elongate wall having opposite edges extending parallel to a central longitudinal axis of the sleeve with the wall being having warp yarns extending parallel to the central longitudinal axis and fill yarns extending transverse to the warp yarns; and weaving the warp yarns in discrete bundles of yarns, each of the bundles having warp yarns arranged in side-by-side abutting relation with one another, with the warp yarns in each discrete bundle extending over and under the same fill yarns with one another.

12. The method of claim 11 further including weaving the bundles over and under a single fill yarn.

13. The method of claim 11 further including weaving the bundles over a plurality of fill yarns to form outwardly facing floats.

14. The method of claim 11 further including heat-setting at least some of the fill yarns to bias the opposite edges into overlapping relation with one another.

15. The method of claim 11 further including providing at least some of the warp yarns as multifilament yarns.

16. The method of claim 15 further including providing the fill yarns as multifilament yarns.

17. The method of claim 15 further including providing the fill yarns as monofilament yarns.

18. The method of claim 15 further including providing at least some of the warp yarns as monofilament yarns.

19. The method of claim 18 further including forming each of the discrete bundles including multifilament and monofilament yarns.

20. The method of claim 11 further including weaving the warp yarns and the fill yarns in a basket weave pattern.

* * * * *